US009365976B2

(12) United States Patent
Hada et al.

(10) Patent No.: US 9,365,976 B2
(45) Date of Patent: Jun. 14, 2016

(54) ENDLESS BELT CHANGING APPARATUS AND METHOD

(71) Applicant: Kimberly-Clark Worldwide, Inc., Neenah, WI (US)

(72) Inventors: Frank Stephen Hada, Appleton, WI (US); Robert Eugene Krautkramer, Combined Locks, WI (US); Mark John Hassman, Oshkosh, WI (US); Robert James Seymour, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 14/429,653

(22) PCT Filed: Oct. 31, 2014

(86) PCT No.: PCT/US2014/063291

§ 371 (c)(1),
(2) Date: Mar. 19, 2015

(87) PCT Pub. No.: WO2015/069555

PCT Pub. Date: May 14, 2015

(65) Prior Publication Data

US 2016/0024715 A1 Jan. 28, 2016

Related U.S. Application Data

(60) Provisional application No. 61/900,145, filed on Nov. 5, 2013.

(51) Int. Cl.
*D21F 7/08* (2006.01)
*D21F 7/00* (2006.01)

(52) U.S. Cl.
CPC ..... *D21F 7/086* (2013.01); *D21F 7/001* (2013.01)

(58) Field of Classification Search
CPC ..... D21F 7/08
USPC ..... 162/205, 202, 348
See application file for complete search history.

(56) References Cited

U.S. PATENT DOCUMENTS

| | | | |
|---|---|---|---|
| 2,360,773 | A | 10/1944 | Helin |
| 2,681,721 | A | 6/1954 | Baxter, Jr. et al. |
| 3,129,135 | A | 4/1964 | Lloyd et al. |
| 4,138,316 | A | 2/1979 | Kessler et al. |
| 4,220,501 | A | 9/1980 | Skaugen |
| 4,267,018 | A | 5/1981 | Haltsonen et al. |
| 4,450,630 | A | 5/1984 | Phelps |
| 4,875,975 | A | 10/1989 | Schiel |

(Continued)

FOREIGN PATENT DOCUMENTS

| | | | |
|---|---|---|---|
| DE | 335449 | A | 4/1921 |
| DE | 351120 | A | 4/1922 |

(Continued)

*Primary Examiner* — Mark Halpern
(74) *Attorney, Agent, or Firm* — Kimberly-Clark Worldwide, Inc.

(57) ABSTRACT

The invention relates to methods and an apparatus useful to installing and removing endless belts in a conveyor system and more preferably continuous fabrics, belts, felts and webs used in the papermaking process. According to the present invention a pair of guide rolls to move a first continuous fabric from a first fabric position to a second fabric position and a second fabric from the second fabric position to the first fabric position, passing the fabrics over one another as the position of the fabrics are exchanged. The movement of the first and second fabrics may be done at the same time so as to further enhance the efficiency of changing fabrics.

20 Claims, 7 Drawing Sheets

(56) References Cited

U.S. PATENT DOCUMENTS

| | | | |
|---|---|---|---|
| 5,400,708 | A | 3/1995 | Meschenmoser |
| 5,823,464 | A | 10/1998 | Bohn et al. |

FOREIGN PATENT DOCUMENTS

| | | | |
|---|---|---|---|
| EP | 1 375 744 | B1 | 6/2007 |
| GB | 0 393 476 | A | 6/1933 |
| GB | 0 557 387 | A | 11/1943 |
| GB | 0 888 324 | A | 1/1962 |
| GB | 1 207 931 | A | 10/1970 |
| JP | 63-180615 | A | 7/1988 |
| JP | 01-275316 | A | 11/1989 |
| JP | 03-056311 | A | 3/1991 |
| JP | 2001-122418 | A | 5/2001 |
| WO | WO 2007/144461 | A1 | 12/2007 |
| WO | WO 2010/102878 | A2 | 9/2010 |

ENDLESS BELT CHANGING APPARATUS AND METHOD

RELATED APPLICATIONS

The present application is a national-phase entry, under 35 U.S.C. §371, of PCT Patent Application No. PCT/US14/63291, filed on Oct. 31, 2014, which claims priority to U.S. Provisional Patent Application No. 61/900,145, filed on Nov. 5, 2013, all of which are incorporated herein by reference in a manner consistent with the present application.

BACKGROUND OF THE DISCLOSURE

In the manufacture of tissue products such as facial tissue, bath tissue, paper towels and the like, it is often necessary to change certain endless belts, such as through-air drying fabrics, on the papermaking machine when changing over to different products or grades. For example, when switching between making through-air dried bath tissues and towels, the through-air drying fabric typically needs to be changed each time a different product is to be made because the desired three-dimensional topography of each product is typically different. In order to change the fabric, the paper machine must be shut down, which results in several hours of machine down time and loss of productivity. Also, repeated shutdowns and start-ups of the machine and the attendant, and drop and rise in processing temperatures cause thermal cyclic fatigue to the through-air dryers, which ultimately necessitates a costly replacement.

In addition to changing fabrics to accommodate different grades of papermaking, fabrics need to be replaced periodically as they often wear or become brittle with age. Like the substitution of fabrics, replacement requires that the paper machine must be shut down, which results in several hours of machine down time and loss of productivity.

Therefore, there is a need to improve the process of changing papermaking belts so as to reduce machine down time, improve operating efficiency and avoid many of the problems associated with starting and stopping the papermaking machine.

SUMMARY OF THE DISCLOSURE

The present inventors have now discovered a simple and elegant means of removing or installing an endless machine belt rotatably mounted between a pair of supports without having to stop the rotation of the belt. The present inventors have also discovered a means for simultaneously removing and installing an endless belt on a machine, more particularly a papermaking machine and still more specifically a tissue-making machine. Further, removal and installation of endless belts on a machine may be accomplished using many of the rolls currently existing on the machine, increasing the efficiency and safety and reducing the cost of changing fabrics.

Accordingly, in one embodiment the present invention an apparatus for replacing a first endless belt on a machine with a second endless belt, the first endless belt supported by a drive roll, a support roll and guide roll, the apparatus comprising a first drive roll adapted for driving a second endless belt, a first guide roll adapted for guiding a second endless belt and aligned out of plane with the machine guide roll, the first guide roll rotating about a first axis and movable about a second axis transverse to the first axis; a drive means for effecting the movement of the first guide roll; and a support roll for supporting a second endless belt.

In another embodiment the present invention provides a method of installing an endless belt on a machine comprising the steps of providing a machine having a first and a second machine rotatable roll; providing an apparatus comprising an endless belt supported by a drive roll and a guide roll; rotating the endless belt; angling the guide roll to applying a first force to the endless belt along a first axis, whereby the endless belt is moved from guide roll and the drive roll to the first and the second machine rolls.

In still other embodiments the present invention provides a method of changing an endless belt comprising the steps of providing a first endless belt and a second endless belt, rotating the first and the second endless belts in the same direction, applying a first force to the first endless belt along a first axis, and applying a second force to the second endless belt along a second axis, wherein the first and second axis are different. The forces applied to the first and second endless belts may be applied at the same time, i.e., simultaneously, or at different times.

In yet other embodiments the present invention provides a method of changing a papermaking fabric comprising the steps of providing a first fabric supported by a drive roll, a first guide roll and a tension roll, providing a second fabric supported by a second drive roll, a second guide roll and a second tension roll, rotating the first and second fabrics in the same direction, moving the first guide roll to apply a first force to the first fabric, and moving the second guide roll to apply a second force to the second fabric. In certain embodiments the movement of the first and second guide rolls may be coordinated so as to apply a first and a second force in a coordinate fashion, such as simultaneously. In this manner the first fabric is moved in an opposite direction to the second fabric so the position of the two fabrics may be interchanged. In other embodiments the first and second guide rolls may be moved separately.

In still other embodiments the present invention provides an apparatus for replacing a first endless belt with a second endless belt, the apparatus comprising a first drive roll adapted for driving a first endless belt, a first guide roll adapted for guiding the first endless belt, the first guide roll rotating about a first axis and having skewing movement about a second axis transverse to the first axis and a skewing means for effecting the skewing movement of the first guide roll, a second drive roll adapted for driving a second endless belt, a second guide roll adapted for guiding the second endless belt, the second guide roll rotating about a first axis and having skewing movement about a second axis transverse to the first axis and a skewing means for effecting the skewing movement of the second guide roll.

Other features and aspects of the present invention are discussed in greater detail below.

BRIEF DESCRIPTION OF THE DRAWINGS

Various non-limiting embodiments are further described with reference to the accompanying drawings in which.

DETAILED DESCRIPTION OF THE DISCLOSURE

Figure 1:
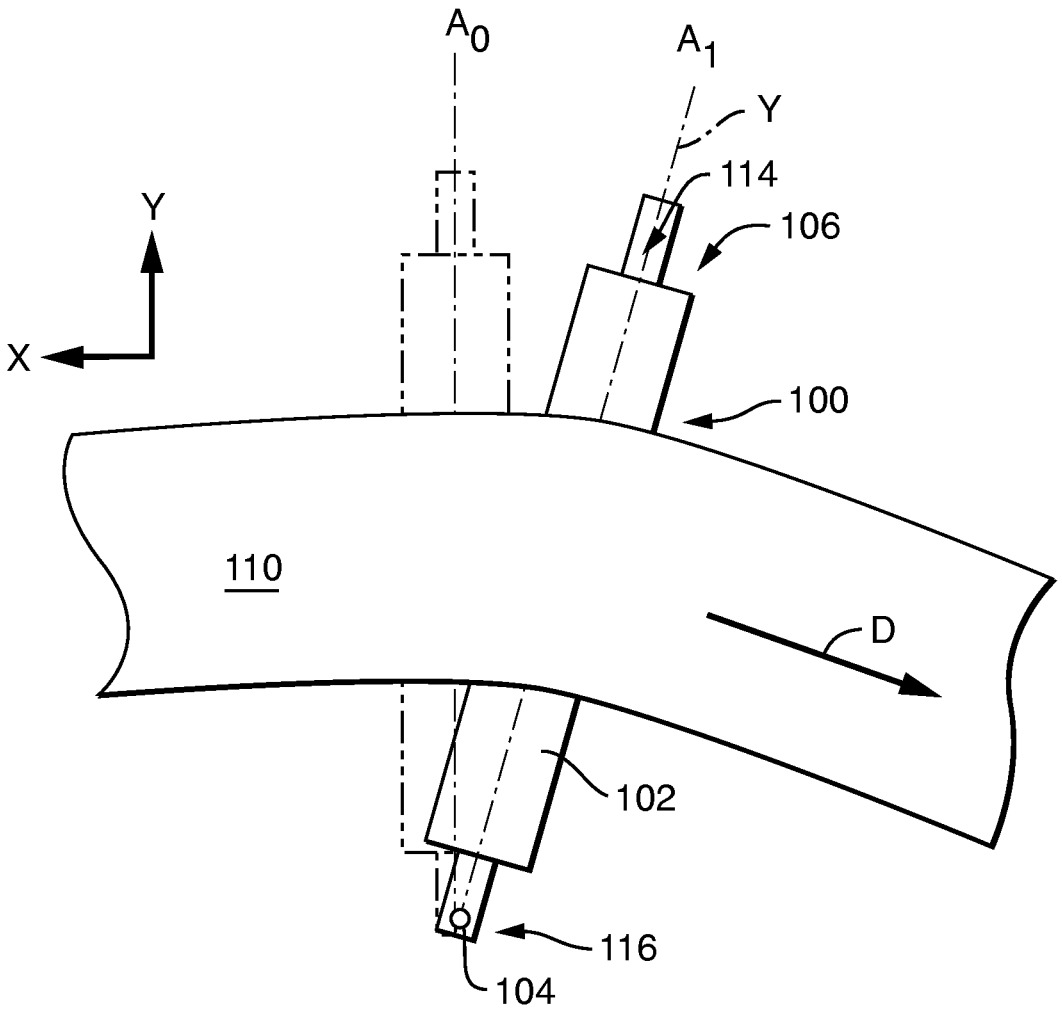
FIG. 1 illustrates one embodiment of an end pivoted guide for adjusting the lateral position of a fabric.

Generally, the present invention is applicable to the removal or installation of any continuous, also referred to herein as endless, belt or web. The methods and apparatus of the present invention may be used to install or remove an endless belt of a machine without ceasing operation of the machine. The ability to install or remove a belt without stopping the machine provides operational efficiencies and reduces the likelihood of damage to the machine associated with starting and stopping.

While it is not necessary to stop the machine to install or replace an endless belt thereon, the invention is not so limited. In certain embodiments, it is possible to stop the machine before installing or removing an endless belt. It is also possible to start and restart the machine any time during installation or removal of the endless belt.

While in the most basic sense the invention provides for the removal or installation of an endless belt on a machine, in certain preferred embodiments an endless belt may be simultaneously removed and installed. For example, in certain embodiments the apparatus may be used to install a through-air drying fabric on a tissue machine, while simultaneously removing an existing through-air drying fabric from the machine.

The method and apparatus of the present invention, while applicable to the removal and installation of any endless belt supported by a pair of rotatable support rolls, is particularly well suited to the installation and removal of endless belts found in the papermaking process. The papermaking process and apparatuses useful therefore may generally be considered as a series of process conveyors from the headbox to the reel. This series of process conveyors transport the paper web from the headbox, where the paper web is primarily water, to the reel, where the paper web consists essentially of dried cellulosic fibers. Endless belts useful in the manufacture of paper and tissue are well known and may include, for example, forming fabrics, press felts, drying felts, through-air drying fabrics, transfer fabrics, impression fabrics, and the like.

The series of process conveyors in the papermaking process generally consist of two or more rolls supporting an endless belt, such as a forming fabric, press felt, drying felt, through-air drying fabric, transfer fabric, impression fabric, and the like (commonly referred to herein as a "fabric"). The materials and construction of the fabric may vary depending on its function in the papermaking process and may include woven and non-woven fabrics. The materials and construction of the fabric however, are not germane to the present invention so long as the fabric is endless and is supported by a pair of rolls.

Generally fabrics to be installed and removed are supported by two or more rolls, one of which may be driven by a drive means. Suitable drive means, such as drive motors, are well known in the art and generally drive a roll in a rotation motion to pull the fabric across the rolls and control the speed and travel of the fabric. In certain embodiments the fabric may be driven by one or more drive rolls, such as a roll having a drive means operatively associated therewith, such as two drive rolls or three drive rolls. Regardless of the number of drive rolls, in certain embodiments it may be preferred to use a drive roll having a textured surface so as to provide static friction between the drive roll and fabric being driven. While it may be preferable in certain embodiments to provide a drive roll capable of providing static friction with the fabric in use, the construction, shape and size of the rolls may vary, with the properties of each varying as needed to facilitate the papermaking process and rapid fabric changes.

In certain embodiments the fabric is supported by one or more support or tension rolls which, in certain embodiments, may be a straight-faced roll, a non-driven bowed roll, a crowned roll, or a roll that has its ends dubbed can be successfully used. The position of the support rolls are generally fixed so as to only provide rotational motion as the supported fabric is moved across its surface. Unlike support rolls, the position of tension rolls, also referred to as stretch rolls, is movable in one or more axis, as well as being rotatable about the axis. Generally the support or tension rolls are positioned relative to one another and the one or more drive rolls such that the maximum unsupported fabric run is less than about the width of the fabric. For example, less than about 200 inches, more preferably less than about 150 inches and still more preferably less than about 100 inches, such as from about 80 to about 150 inches.

In addition to drive and support rolls the apparatus of the present invention may further comprise a guide roll. In certain embodiments the fabric may be designed to run under uniform cross machine tension and the loads on the drive, support and tension rolls are aligned parallel to one another so as to provide uniform belt path length. Any difference in the machine direction path length will distort the fabric as a result of a mechanical force being applied to the fabric. To counteract such forces, conveyor systems, including those employed in the present invention, may be provided with a guide roll. The guide roll applies a force, generally a friction force, to the fabric which counteracts the force applied by the other rolls in the system.

Referring to FIG. 1, where a top view of a pivot guide roll is illustrated, it can be seen that the guide 100 may comprise a roll 102 mounted to a pivoting base 104. Guide rolls are well known in the art and any suitable guide roll may be used in the present invention. While the construction of the guide roll is not limiting, in certain embodiments the guide roll may be a steel roll. In other embodiments, the guide roll may be in an abrasion-resistant rubber roll cover with polyurethane coating. In still other embodiments the guide roll may be a steel roll with a rubber or other compliant frictional material coating. Generally the guide roll 102 is rotatable on a roller shaft 114. Roller shaft 114 is connected at one end to a roller pivot joint 116 which is suitably mounted on a frame (not illustrated) at points above and out of the way of the fabric 110. Thus, the guide 100 is movable about the pivot shaft 114. In other embodiments the guide may be a pivot guide roll comprising a roll, a bearing housing and bearings, a guide frame for mounting the guide roll to the machine, a guide saddle to support the guide roll bearing housing, and an actuator to move the saddle within the guide frame.

Means for controlling and moving a guide roll are well known in the art and may be readily adapted for use in the present invention. For example, in certain embodiments the guide roll may be a cylindrical roll adapted for rotational movement about a first axis and a skewing or pivoting movement about a second axis transverse to the first axis. Skewing of the guide roll, also referred to herein as pivoting, may be achieved by a drive system known in the art, including for example, electric motors, pressure bellows, diaphragm cylinders, pneumatic or hydraulic cylinders, and the like. In one embodiment one end of the guide roll is mounted on a carriage by a pair of bearings which are slidably received on the guide, A block having an internally threaded bore is mounted on the carriage. A motor having an output shaft, which drives a lead screw is further provided. The lead screw is preferably rotatably supported at the end opposite the motor by a suitable bearing support. Further, the motor and support are mounted on a frame external to the guide roll. The threads of the block engage the threads of the lead screw and it will be readily appreciated that as the motor rotates the lead screw, the carriage will be driven transversely as the block travels along the lead screw. The direction of rotation of motor governs the direction of movement of the carriage and in-turn the guide roll.

In other embodiments a plurality of drives, which in this example embodiment includes a first drive and a second drive, are used to position the guide roll. In some example embodiments, drives are used to pivot the guide roll so as to be misaligned with an adjacent support or drive roll causing the fabric to move in the lateral direction. In this manner multiple drives are used to create a non-uniform tension across the width of fabric as it traverses an adjacent roller (e.g. represented by a substantially non-uniform stress distribution FM and FR in FIG. 3). The first and second drives may each be independently controllable to position corresponding ends of the guide roll to create a misalignment between the guide roll and the adjacent roll. Each drive includes motive elements that convert energy into mechanical motion. Further the drives can include transmission members that can include suitable belts, screws, rack and pinions, and the like.

Further, positional adjustment of the guide roll may be determined and controlled using methods well known in the art. For example, in one embodiment the positional adjustment is determined by control circuitry which produces signals representative of lateral fabric edge position, a desired fabric edge position, and either a guide roper position or an instantaneous lateral fabric deviation rate to produce a control signal which is applied to a gear motor to control the skew angle of the guide roller.

Web guides may be positioned at different locations along the apparatus where guiding is required. In one particularly preferred embodiment the apparatus employs web guides provided in an intermediate papermaking process such as drying and more preferably through-air drying where the guide maintains the lateral positioning of the fabric used to support the paper web during drying, such as a through-air drying fabric. Generally guides are positioned between a first upstream roll and a second downstream roll, where the distance between the first and second rolls is L and the distance between the first roll and the guide roll is about ⅔(L). In a particularly preferred embodiment the distance L is about the width of the fabric being guided. Further the wrap angle of the fabric as it passes over the guide is sufficient to provide sufficient force to guide the fabric as it passes over the roll, such as a wrap angle of about 20 degrees or greater, such as from about 25 to about 35 degrees.

The type of guide may be any of those known in the art, for example, the guide may be an end pivoted guide, such as the guide illustrated in FIG. 1, where the change in the axis of rotation of the roller 102 is about a pivot point 104, which is at one end of the roller. Alternatively, the guide may be a center pivoted guide which has its pivot point in the center of the guide roller. In still other embodiments the guide may be an offset-pivot guide which utilizes a pair of rollers mounted on a pivot carrier to change the axis of rotation.

Regardless of the specific type of guide it is preferred that when the guide is actuated the guide provides a force to the fabric which is different than the force applied to the fabric by the conveyor system. Guide forces may be applied using any one of the different means known in the art, such as an end pivoted guide roll, a center pivoted guide roll or an offset-pivot guide roll. In one instance the guide force is applied by pivoting a guide roll about a guide bearing disposed at one of its ends. Pivoting the guide roll misaligns the guide roll relative to the fabric path causing the fabric to move.

Figure 2:
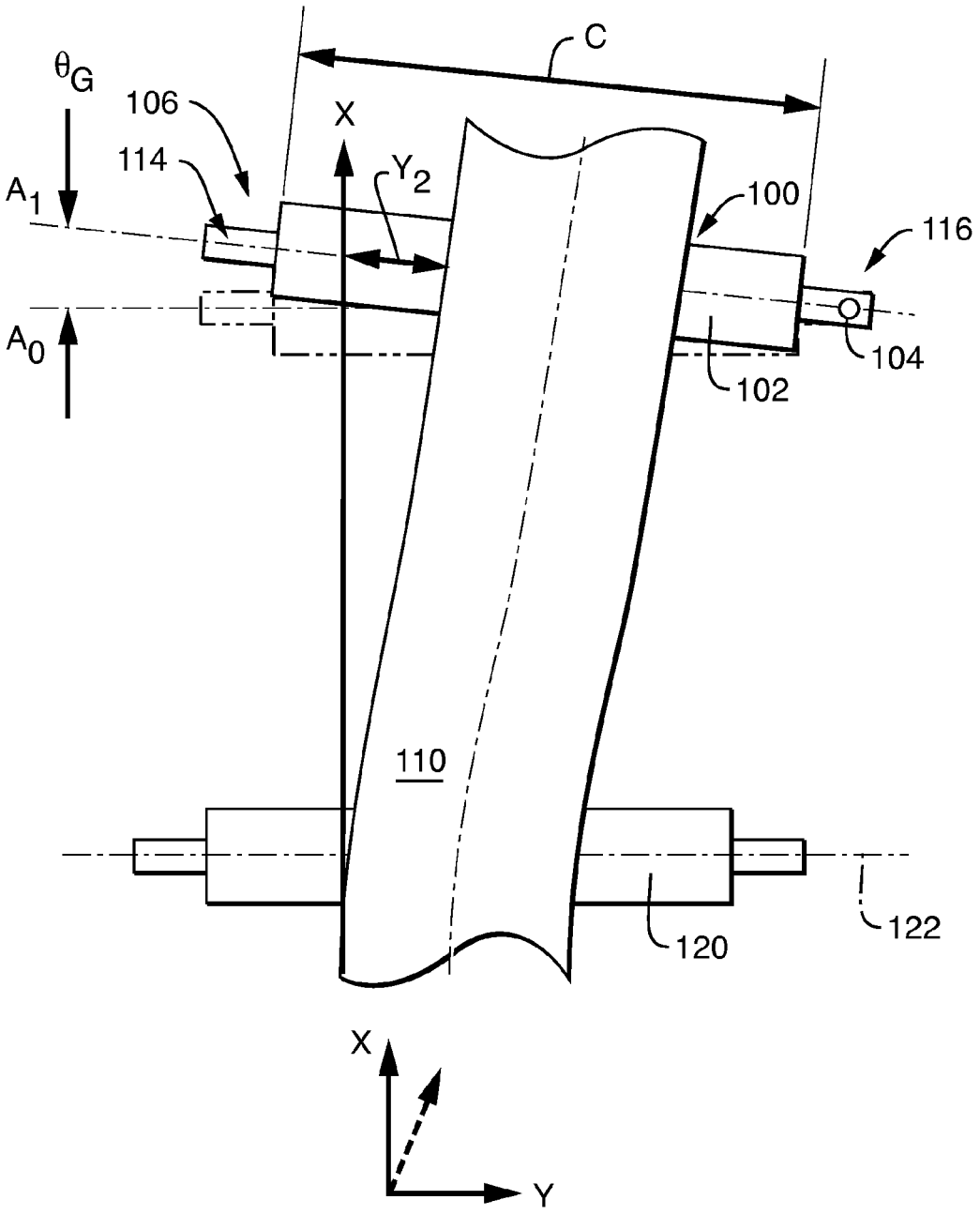
FIG. 2 illustrates the lateral movement of a fabric in response to the pivotal movement of a guide roll.

As illustrated in FIG. 2, in one embodiment, the guide 100 is pivotally supported at one end 104 for pivotal movement about an axis perpendicular to the fabric 110. The adjacent support roll 120, the longitudinal axis of which is oriented perpendicular to the fabric 110, is preferably fixed along its longitudinal axis and acts to support the fabric 110. The guide roller 102 is displaced by moving the first end of the roller 106 along the longitudinal direction, where c is the distance from the first end 106 to the pivot point 104 of the guide roller 102 and $\theta_G$ is the angle of the guide roll displacement, also referred to here as the skew angle. The amount of displacement (U) by moving the first end of the roller 106 is equal to the product of $\theta_G$ and c. When the guide roller 102 is displaced a force (F) is applied to the fabric 110, which is generally traveling the direction indicated by the arrow at a velocity (v), causing the fabric 110 to be moved along the guide roller 102 in its longitudinal axis (Y) a distance $Y_2$.

With reference to FIG. 2, which illustrates a schematic plan view of a typical misalignment that can be imposed between a support roll 120 and a guide roll 100 during removal or installation of an endless fabric 110 traveling in a first direction (D). In this case misalignment occurs between the support roll 120 and the guide roll 100. FIG. 2, shows that if the axis of rotation 122 of support roll 120 and the axis of rotation 118 of the guide roll 100 were both intersected by a common axis 140, the misalignment would prevent common axis 140 from being perpendicular to both the axis of rotation 122 and the axis of rotation 118. In this case guide roll 100 is skewed with respect to the orientation of support roll 120. The skew of guide roll 100 can be expressed in the x-y coordinate frame by an angle θ referenced from the y-axis. As illustrated herein, orientations of various rollers are referenced with respect to the y-axis. This is done for convenience, and it is to be understood that these orientations can be referenced with respect to other directions. For example, the orientation of the various rollers can be referenced with respect to a direction of a path that the rollers are conveyed along. In this illustrated embodiment, various rollers are conveyed along a path aligned with the x-axis.

The degree of misalignment, angle θ, useful for carrying out the invention may vary depending on the width of the fabric (W), the length of the guide roll (c) and the desired amount of displacement (U). Although narrower web widths can be used in attempt to lessen the degree of misalignment necessary to achieve the objective of the invention, this approach is unsatisfactory when larger web widths are required. Alternatively, the use of longer web lengths between the guide roller and adjacent support or drive roll can be used in attempt to facilitate removal of the fabric from the conveying apparatus, but this approach may also have limitations as it is generally preferred to have the web support at not less than the width of the fabric being supported.

As illustrated in FIG. 2, when the guide roll 102 is pivoted or skewed a resulting non-uniform stress distribution is created on the fabric 110 as a result of the misalignment. In this manner the normal axis 140 of the fabric 110 becomes skewed relative to the perpendicular axis 122 of the support roll 120. Further, the forces imposed on the fabric by the misalignment cause the fabric to be displaced in the y-direction, generally perpendicular to the direction of fabric travel. The displacement is such that the fabric is moved from a first position, referred to herein as the machine position, to a second position, referred to herein as the replacement position.

It has now been discovered that in addition to controlling the lateral position of the fabric, the guide may also be used as a means for removing the fabric from the conveyor. Further, a second guide may be provided to support and guide a second fabric, which may be moved in a lateral direction opposite that of the first fabric such that the second fabric may be instated in place of the first fabric. In this manner a simple and efficient means of removing a first fabric and replacing it with a second fabric is provided.

Figure 3:
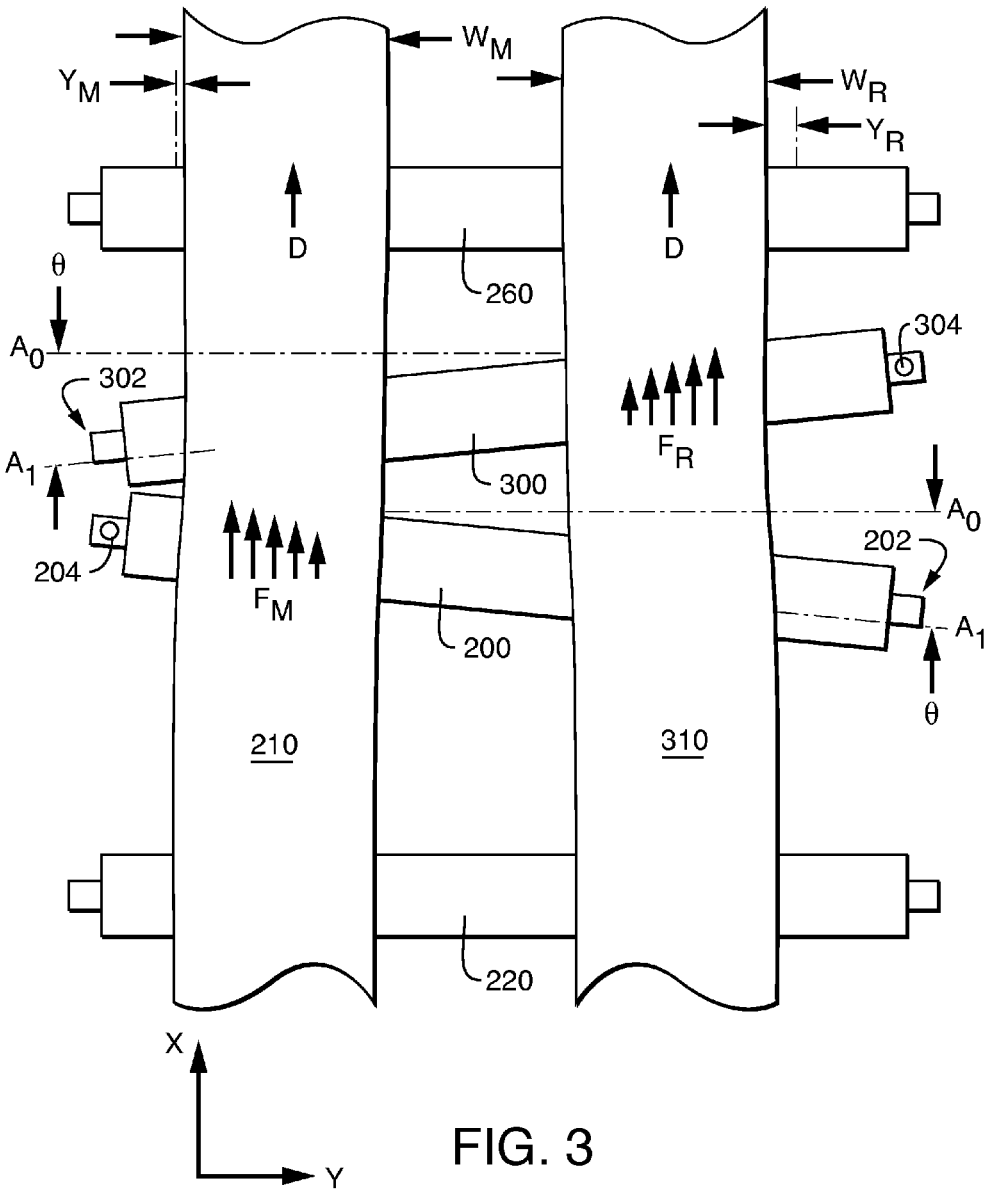
FIG. 3 is a top view of a partial apparatus useful for changing a fabric.

Turning now to FIG. 3, according to one embodiment of the present invention, the machine guide rot 200 not only controls the lateral motion of the machine fabric 210 during normal operation, but may also be used to remove the machine fabric 210 from the machine. In this manner, the machine fabric 210 (also referred to as the first fabric) is supported and driven by a drive rot 220 while supported and guided by a tension rot 260 and a first guide rot 200. In a similar manner the replacement fabric 310 (also referred to as the second fabric) is driven by the drive rot 220 and supported and guided by the tension rot 260 and second guide rot 300.

During normal operation the machine fabric 210 is rotated in a first direction (D) and proper orientation within the conveyor system is maintained by pivoting the first guide rot 200. To replace the machine fabric 210 with the replacement fabric 310 the first guide rot 200 is skewed so as to move the machine fabric 210 in a lateral direction relative to the first guide rot 200. In a particularly preferred embodiment the first guide rot 200 is pivoted by moving the first end 202 of the first guide rot 200. In this manner the first guide rot 200 is moved in a pivotal motion in a direction along a longitudinal axis (A) extending from the first end 202 to the pivot point 204 of the first guide roll 200 from a first axial position ($A_0$) to a second axial position ($A_1$). Similarly the second guide roll 300 is moved in a lateral direction by moving the first end 302 of the second guide roll 300 in a direction along a longitudinal axis extending from the first end 302 to the pivot point 304 of the second guide roller 300. In this manner the second guide roll 300 is pivoted from a first axial position ($A_0$) to a second axial position ($A_1$). The angular difference between $A_0$ and $A_1$ is generally referred to as the degree of misalignment or skew angle and expressed as $\theta$.

Pivoting the second guide rot 300, which is in contact with the replacement fabric 310, causes the replacement fabric to move along the guide roller 300 in its longitudinal axis (Y) a distance $Y_R$. Likewise pivoting the first guide roll 300, which is in contact with the machine fabric 210, causes the machine fabric to move along the guide roller 200 in its longitudinal axis (Y) a distance $Y_M$. In this manner the guide rolls 200, 300 may be pivoted simultaneously, or in other embodiments at different times, so as to move the machine fabric 210 from a first position ($P_1$) to a second position ($P_2$) and to move the replacement fabric 310 in a direction opposite that of the machine fabric from its original position ($P_1$) to the original position of the machine fabric ($P_2$). In this manner the machine fabric 210 moves over, or in other embodiments under, the replacement fabric 310 as the position of the two fabrics are exchanged. As the position of the two fabrics are exchanged they are generally supported by common rods, with the exception of the guide rolls and in certain embodiments a tension rot, which may account for different fabrics lengths.

Once the machine fabric 210 has been exchanged with the replacement fabric 310 the first guide rot 200 skew angle may be reduced and the guide rot 200 may resume normal operation guiding the replacement fabric in the same manner as the original machine fabric.

Generally the length of the guide rolls 200, 300 is equal to or greater than the sum of the width of the fabrics $W_m$ and $W_R$. The guide rolls 200, 300 may comprise separate rots, two or more connected rods or a single continuous roll. Where the guide roll comprises one or more rolls, the rolls preferably work in concert with one another to guide the fabric in a continuous manner as it is moved laterally along its surface. In this manner each fabric is continuously supported by a guide roll as it is moved from a first to a second position. To accomplish this, it may be preferable to have the guide rolls arranged out-of-plane relative to one another. For example, as illustrated in FIG. 4, the guide roll 200, which supports and controls the lateral position of the machine fabric 210, is positioned in a first z-position and out-of-plane relative to the second guide roll 300, which is positioned in a second z-position.

Figure 4:
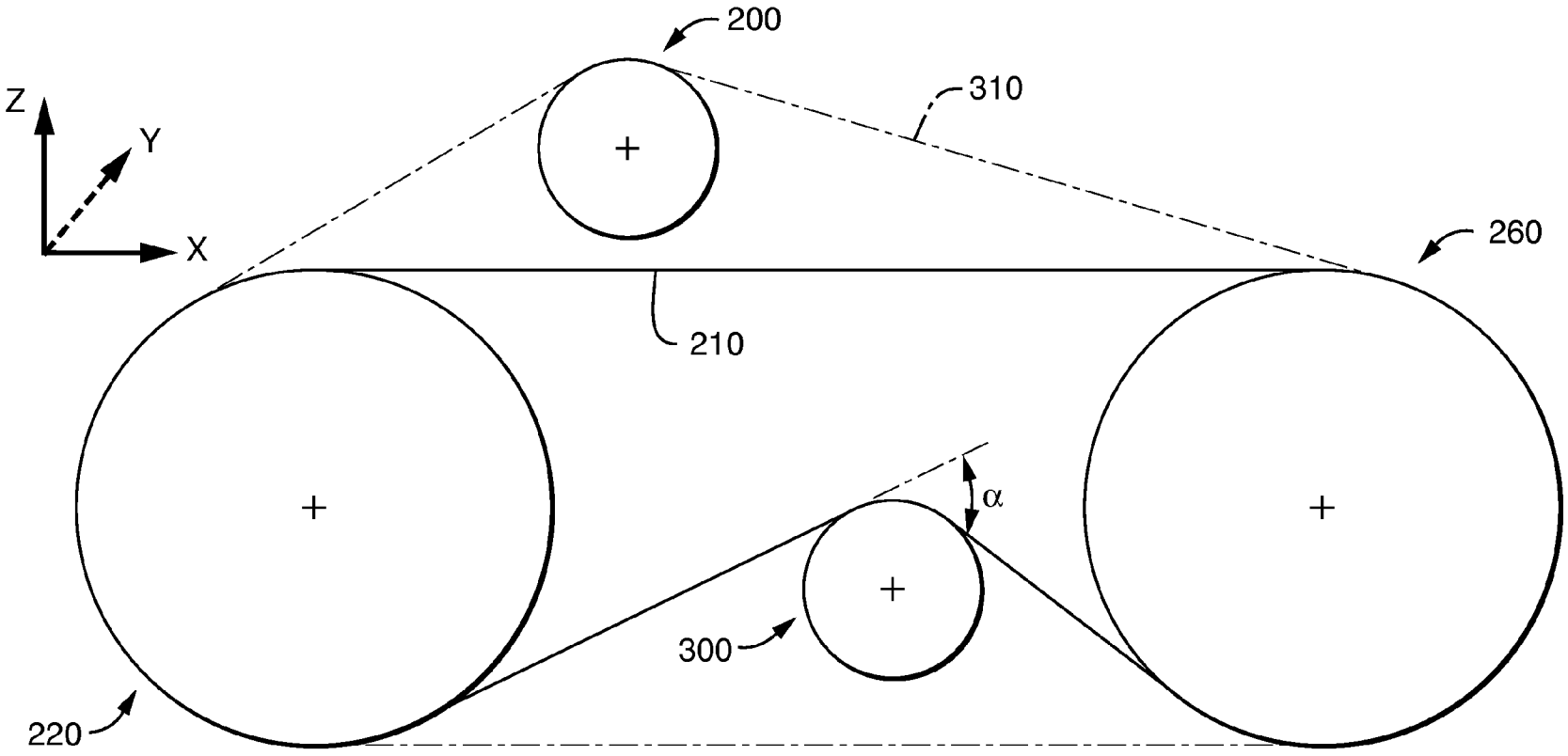
FIG. 4 is a side view of an apparatus useful for changing a fabric according to one embodiment of the present invention.
Figure 5:
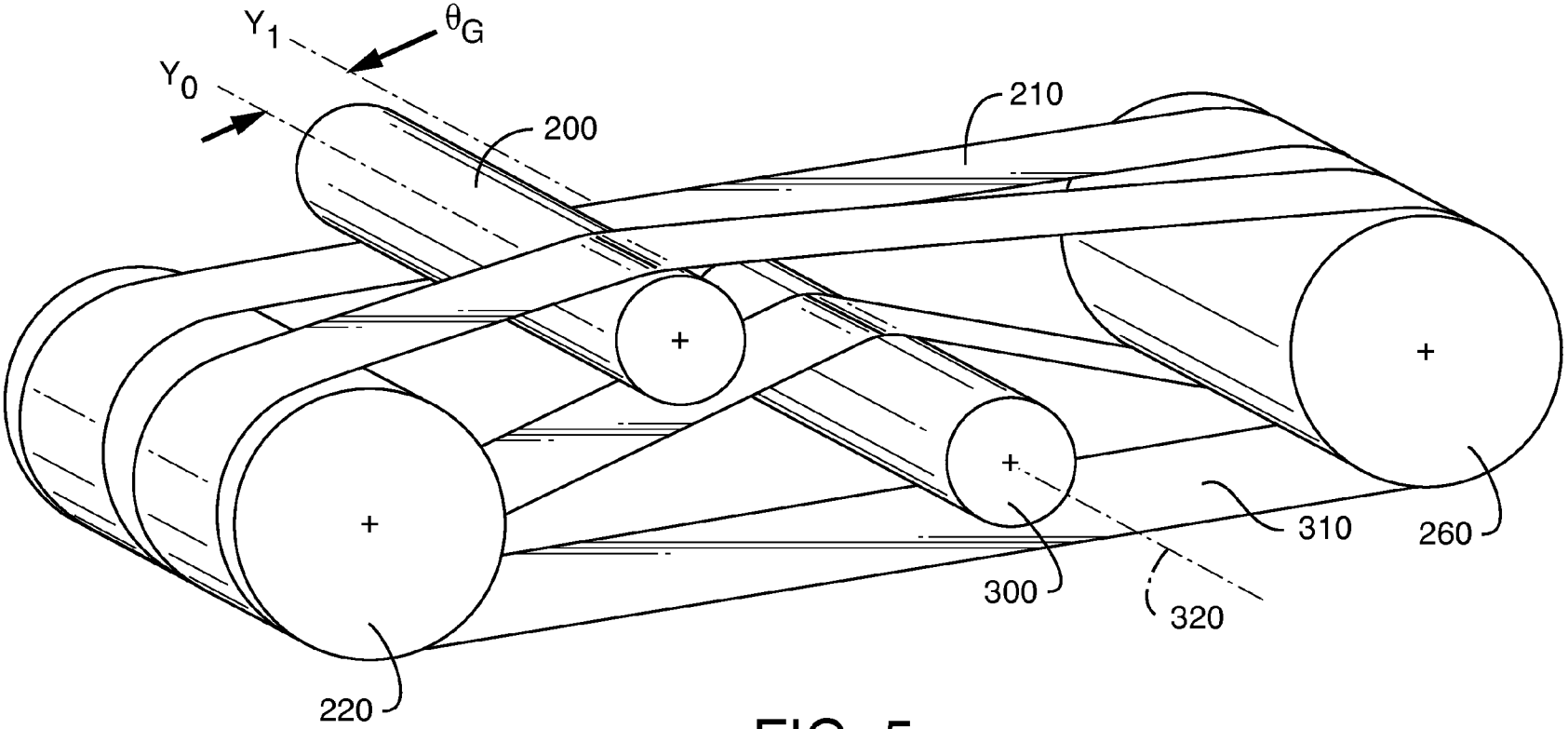
FIG. 5 illustrates a perspective view of the apparatus illustrated in FIG. 4.

The arrangement of the guide rolls relative to one another, and to the other rolls in the conveyor system, is further illustrated in FIG. 5, which is an isometric view of the system illustrated in FIG. 4. As illustrated in FIG. 5, the guide rolls 200, 300 are out-of-plane relative to one another and have a length that is generally at least as wide as the fabrics 210, 310. Each guide roll 200, 300 supports and guides a different fabric and may be pivoted about an axis so as to apply a force to the supported fabric, changing the lateral position of the fabric. As further illustrated, the drive roll 220 and tension roll 260 are approximately the length of the guide rolls 200, 300 and commonly drive and tension the fabrics 210, 310. In other embodiments, the fabrics may be tensioned and driven by separate rolls.

Figure 6:
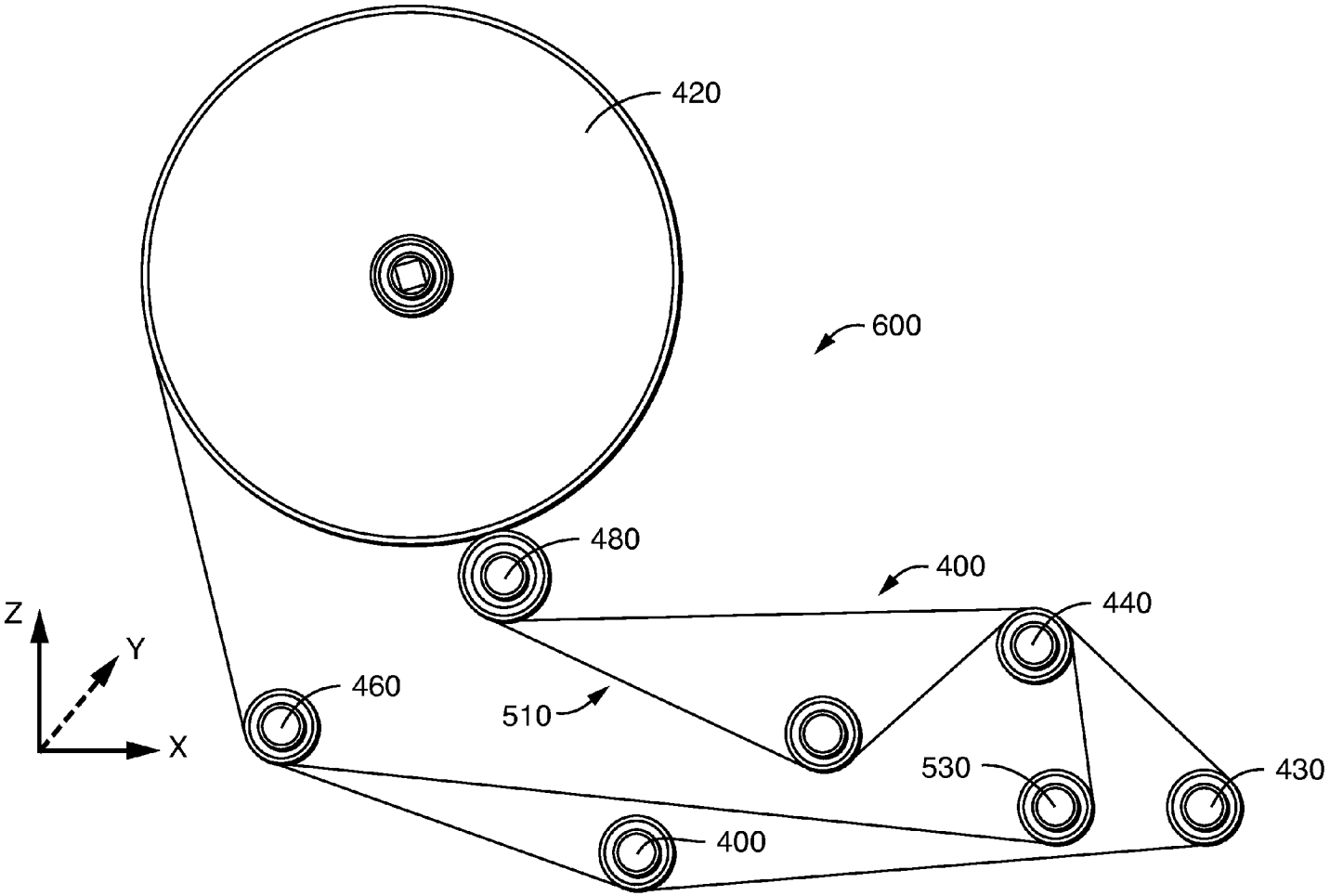
FIG. 6 illustrates a side view of an apparatus useful for changing a through-air drying fabric according to another embodiment of the present invention.

While the present invention may be useful in the replacement of any endless fabric in a conveyor system, it is particularly well suited to replacing fabrics found in the dryer sections of the papermaking process and more particularly through-air drying fabrics. Turning now to FIG. 6, one embodiment for replacing a machine fabric 410 with a replacement fabric 510 on a through-air dried tissue machine is illustrated. In the illustrated embodiment the machine fabric 410 travels over a series of rolls to guide, drive and tension the fabrics as they pass over the through-air dryer 420. As illustrated the machine fabric 410 is longer than the replacement fabric 510. The tension of the machine fabric 410 is controlled by a first tensioning roll 430 and guided by a first guide roll 400, which is preferably pivotable about an axis so as to move the roll in the y-direction. The tension roll 430 is generally moveable in the x-direction, as is known in the art, to control the tension of the machine fabric 410. The replacement fabric 510, which is shorter than the machine fabric 410, is tensioned by a second tension roll 530, which like the first tension roll 430 is generally moveable in the x-direction. The replacement fabric 510 is guided by a second guide roll 500, which is preferably pivotable about an axis so as to move the roll in the y-direction. The first 400 and second 500 guide rolls are positioned out-of-plane relative to one another so as not to interfere with one another when the rolls are pivoted to exchange the machine fabric 410 with the replacement fabric 510 and so as to continuously act upon their respective fabrics throughout the change process.

During normal operation the machine fabric 410 supports the cellulosic web as it is transported in a serpentine manner throughout the dryer section, partially wrapping the through-air dryer 420. The endless machine fabric 410 is brought into direct wrapping contact with the surface of the through-air dryer 420, as well as the other rolls which make up the dryer section, including the guide roll 400 and tension roll 430. The machine fabric 410 is generally driven by the through-air dryer 420, which is in-turn driven by a drive unit (not illustrated), as is common in the art. During normal operation the guide roll 400 acts to maintain proper alignment of the machine fabric 410 and is driven and controlled using methods known in the art (not illustrated).

Figure 7:
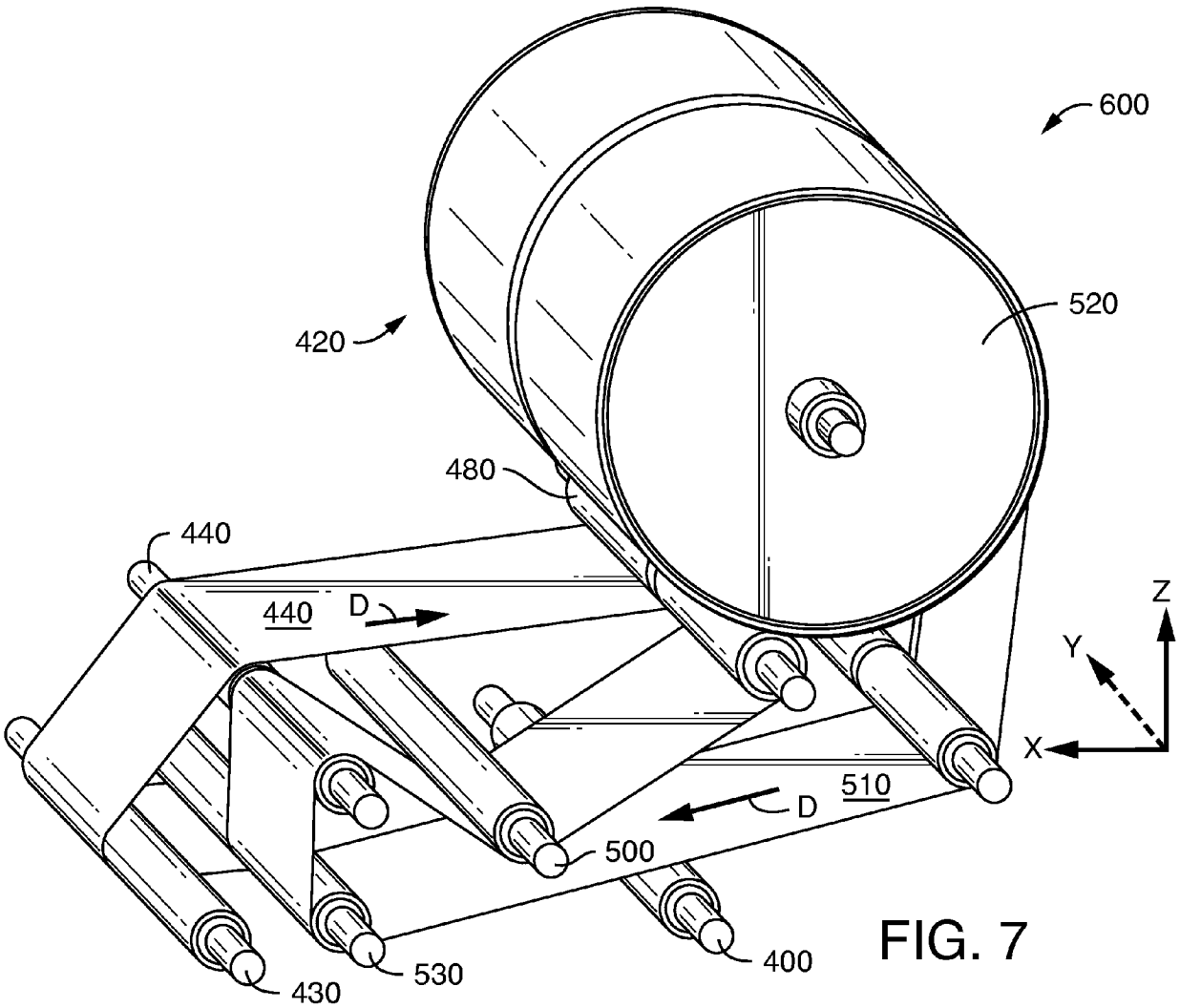
FIG. 7 illustrates a perspective view of the apparatus illustrated in FIG. 6.

As shown most clearly in FIG. 7, to change the machine fabric 410 certain rolls 420, 440, 460 and 480 making up the dryer section 600 have been coupled to a complementary set of rolls 420*a*, 440*a*, 460*a* and 480*a* on the tending side H. These complementary rolls 420*a*, 440*a*, 460*a* and 480*a* in addition to the replacement fabric tensioning roll 530 and replacement fabric guide roll 500 make up the fabric change apparatus. In this manner the machine fabric 410 will be removed by moving the machine fabric 410 away from the drive side D of the dryer section towards the tending side H. When the complementary set of rolls 420*a*, 440*a*, 460*a* and 480*a* are coupled to rolls 420, 440, 460 and 480 of the dryer section 600, the coupled rolls form cross-direction beams orientated substantially perpendicular to the direction of the machine fabric 410. These beams may be cantilever beams which are supported along the drive side D of the dryer section, or may be supported both along the drive side D of the dryer section and by a frame provided along the tending side H (not illustrated).

In one embodiment, to replace the machine fabric 410 with a replacement fabric 510, the replacement fabric is first supported by a plurality of rolls 420*a*, 440*a*, 460*a*, 480*a*, 500 and 530. Rolls 420*a*, 440*a*, 460*a*, 480*a*, are substantially complementary rolls provided in the dryer section 600. As illustrated, when the complementary rolls 420*a*, 440*a*, 460*a* and 480*a* are coupled to the dryer section 600 rolls 420, 440, 460 and 480, the replacement fabric 510 may be driven in a direction D that is substantially perpendicular to the rolls. Driving of the replacement fabric 510 may be carried out by coupling roll 420*a* to the through-air dryer 420 and driving the through-air dryer 420 with a drive mechanism (not illustrated). Because the lengths of the machine fabric 410 and the replacement fabric 510 are different in the illustrated embodiment the dryer tension roll 430 and the replacement fabric tension roll 530 are not shared and do not have complementary rods. Similarly, because the lateral position of the machine fabric 410 and the replacement fabric 510 are to be controlled separately during the fabric change procedure, each fabric is supported by its own guide roll 400, 500. To be clear, while the machine fabric 410 is illustrated as being longer than the replacement fabric 510, in other embodiments the fabrics may be the same length or the replacement fabric may be longer than the machine fabric.

To replace the machine fabric 410 with the replacement fabric 510 and carrying out the fabric change procedure, the machine fabric 410 and the replacement fabric 510 are driven in a first direction D utilizing the through-air dryer drive mechanism. As the fabrics 410, 510 are being driven, the dryer section guide roll 400 may be skewed so as to apply a force to the machine fabric 410 supported thereby and causes the machine fabric 410 to move along the guide roll 400 in its longitudinal axis (Y) away from the drive side (D) towards the tending side (H). In a similar manner the replacement fabric guide roll 500 may be skewed so as to apply a force to the replacement fabric 510 supported thereby, causing the replacement fabric 510 to move along the guide roll 500 in its longitudinal axis (Y) in a direction opposite that of the machine fabric 410, i.e., from the tending side (H) towards the drive side (D).

The fabrics 410, 510 are continuously driven as a force is applied by the respective guide rolls 400, 500 until the machine fabric 410 has been exchanged with the replacement fabric 510. Once the replacement fabric 510 has been positioned in place of the machine fabric 410 the skew angles of the guide rolls 400, 500 may be reduced and normal operation may resume.

While the foregoing invention has generally been described as simultaneously removing and installing an endless belt, one skilled in the art will appreciate that the invention is not so limited. Rather, the apparatus and methods are readily adaptable to either installation or removal independently. Accordingly, in certain embodiments the invention simply provides an apparatus and method for installing or removing an endless belt.

In one embodiment the installation of an endless belt on a machine may comprise the steps of providing a machine having a first and a second machine rotatable roll; providing an apparatus comprising an endless belt supported by a support roll, a guide roll and a tension roll; rotating the fabric; angling the guide roll to applying a first force to the fabric along a first axis, whereby the endless belt is moved from the support roll and the tension roll to the first and the second machine rolls.

We claim:

1. An apparatus for replacing a first endless belt on a machine with a second endless belt, the first endless belt supported by a drive roll, a support roll and a guide roll, the apparatus comprising:

a. a first drive roll adapted for driving a second endless belt, b. a first guide roll adapted for guiding a second endless belt and aligned out of plane with the machine guide roll, the first guide roll rotating about a first axis and movable about a second axis transverse to the first axis;

c. a drive means for effecting the movement of the first guide roll; and d. a support roll for supporting a second endless belt.

2. The apparatus of claim 1 further comprising a first tension roll for supporting and tensioning the first endless belt.

3. The apparatus of claim 1 wherein the machine drive roll and the first drive roll are mechanically coupled such that when the machine roll is driven the first drive roll is also driven.

4. The apparatus of claim 1 further comprising a second endless belt mounted on the first drive roll, first guide roll and support roll and wherein the first guide roll is moveable from a first position to a second position such that the end of the first guide roll is displaced a distance (U) causing a force (F) to be applied to the second endless belt and the second endless belt to be moved along the first guide roller in its longitudinal axis (Y) a distance $Y_2$.

5. The apparatus of claim 1 wherein the first guide roll is end pivoted, center pivoted or an offset-pivot roll and drive means comprise a hydraulic cylinder or a pneumatic cylinder for moving the first guide roll between a first and a second position.

6. A method of installing an endless belt on a machine comprising the steps of providing a machine having a first and a second machine rotatable roll; providing an apparatus comprising an endless belt supported by a drive roll, a guide roll and a support roll; rotating the fabric in a first direction; angling the guide roll to apply a first force to the fabric along a first axis, whereby the endless belt is moved from the drive and support rolls to the first and the second machine rolls.

7. The method of claim 6 wherein the first machine roll is a drive roll driven by a first drive means.

8. The method claim 7 further comprising coupling the drive roll to the machine roll and driving the drive roll by the machine drive means.

9. The method of claim 6 wherein the apparatus further comprises a drive means for driving the drive roll thereby rotating the endless belt.

10. The method of claim 6 wherein the machine is a tissue making machine and the first machine roll is a through-air dryer and the second roll is a tension roll; and further where the endless belt is a through-air drying fabric.

11. The method of claim 6 wherein the first and second machine rotatable rolls are continuously rotating during installation of the endless belt.

12. The method of claim 6 wherein angling the guide roll consists of moving the guide roll from a first position to a second position such that the end of the guide roll is displaced a distance (U) causing a force (F) to be applied to the endless belt.

13. The method of claim 6 wherein the guide roll is an end pivoted, center pivoted or an offset-pivot roll and the guide roll further comprises a hydraulic cylinder or a pneumatic cylinder for angling the guide roll.

14. A method of changing a fabric comprising the steps of:

a. providing a first fabric and a second fabric in a spaced apart relation to one another;

b. rotating the first and the second fabric in the same direction;

c. applying a first force to the first fabric along a first axis; and d. applying a second force to the second fabric along a second axis, wherein the first and second axis are different.

15. The method of claim 14 wherein the first force is applied by a first guide roll, which is pivotable about a first axis that is perpendicular to the direction of travel of the first fabric and the second force is applied by a second guide roll, which is pivotable about a second axis that is perpendicular to the direction of travel of the second fabric.

16. The method of claim 15 wherein the first guide roll is moved from a first position to a second position such that the end of the first guide roll is displaced a distance (U) causing a force (F) to be applied to the second endless belt and the second endless belt to be moved along the first guide roller in its longitudinal axis (Y) a distance $Y_2$.

17. The method of claim 14 wherein the first fabric has a width ($W_1$) and the second fabric has a width ($W_2$) and the first and second guide rolls each have a length ($L_1$ and $L_2$) that is greater than the sum of $W_1$ and $W_2$.

18. The method of claim 14 wherein the first and second forces are applied simultaneously.

19. The method of claim 14 wherein the first and second forces are applied at different times.

20. The method of claim 14 wherein the first fabric has a longitudinal axis that is in a first position ($P_1$) and the second fabric has a longitudinal axis that is in a first position ($P_2$) whereby applying the first and second forces to the first and second fabrics causes the first fabric to move from $P_1$ to $P_2$ and the second fabric to move from $P_2$ to $P_1$.

* * * * *